United States Patent [19]

Leitner

[11] 3,999,414

[45] Dec. 28, 1976

[54] MAXIMUM-SECURITY LOCK

[75] Inventor: Jorg Leitner, Graz, Austria

[73] Assignee: Lapp-Finze Eisenwarenfabriken Aktiengesellschaft, Kalsdorf near Graz, Austria

[22] Filed: Aug. 29, 1975

[21] Appl. No.: 609,070

[52] U.S. Cl. ..... 70/379 A; 70/354

[51] Int. Cl.[2] ..... E05B 9/10; E05B 17/04

[58] Field of Search ..... 70/353, 354, 355, 379 R, 70/379 A, 380, 416, 418

[56] References Cited

UNITED STATES PATENTS

| | | | |
|---|---|---|---|
| 1,549,603 | 8/1925 | Murmann | 70/134 |
| 3,385,086 | 5/1968 | Patriquin | 70/379 A X |
| 3,911,761 | 10/1975 | Cornellier | 70/379 R X |

*Primary Examiner*—Robert L. Wolfe
*Attorney, Agent, or Firm*—Ernest G. Montague; Karl F. Ross; Herbert Dubno

[57] ABSTRACT

A lock assembly has a housing in which is provided a cylinder lock having a shell fixed in the housing and a plug rotatable in the shell by means of a key. A tongue is carried on and jointly rotatable with the plug and is formed with a plurality of bittings each engageable with a respective tumbler in the housing and displaceable into an aligned position. A locking element such as a bolt is engageable with the tumblers and is only displaceable between a locked and unlocked position when the tumblers are in the aligned position. The tongue is formed of a plurality of plates each constituting a respective one of the bittings. Thus even if the cylinder lock is forcibly ripped out of the assembly a tumbler-type lock structure is left within that cannot readily be overcome to allow operation of the locking element.

5 Claims, 3 Drawing Figures

MAXIMUM-SECURITY LOCK

FIELD OF THE INVENTION

The present invention relates to a lock. More particularly this invention relates to a maximum-security lock usable on a door, strongbox, or the like.

BACKGROUND OF THE INVENTION

In recent years the cylinder lock has been used in virtually all key-type lock assemblies. Such a lock comprises a sleeve mounted in the lock housing, and a plug rotatable in this sleeve by means of a key. The tumblers between the shell and the plug allow this plug to be rotated only when a key having appropriate bittings is fitted into the plug. A tongue or pawl carried on this plug serves to operate the locking element within the lock assembly.

Such a lock has been developed to a high degree, with tubular-type keys, magnetic keys, and similar arrangements almost making the lock pickproof. Furthermore the use of new extremely hard metals has made it almost impossible to drill out such a lock to forcibly open it. The key for such a lock is usually small and convenient to carry.

It has been found, however, that in most break-ins or burglaries where a cylinder lock is forced a crude but simple method is used. The bezel ring is pried away from around the cylinder and a wrench is locked on to the shell of the cylinder lock. The cylinder itself is then turned and ripped physically out of the lock assembly so as to expose the internal mechanism which can usually be operated by means of a screwdriver.

In maximum-security arrangements, such as safety deposit boxes, bank vaults, strongboxes, and the like it is known to provide a tumbler-type lock. A bulky key that is relatively expensive to duplicate has a bitting that coacts directly with several tumblers well within the lock structure so as to displace these tumblers into an aligned position that allows a locking element to be displaced. Since all of the operating mechanism is well within the lock and the bitting necessary to move these tumblers into the requisite aligned position is extremely difficult to ascertain, such a lock is not only pickproof but very difficult to force. By the same token such a lock is also quite expensive and, therefore, not adapted to general use.

OBJECTS OF THE INVENTION

It is therefore an object of the present invention to provide an improved maximum-security lock.

Another object is the provision of such a lock which has the advantages of the cylinder lock and the advantages of the tumbler-type of Tosic lock, but which is relatively inexpensive to manufacture.

Yet another object is the provision of a lock assembly which is operated by a conventional cylinder lock but which cannot be opened even if the cylinder lock is forcibly removed.

SUMMARY OF THE INVENTION

These objects are attained according to the present invention in a lock assembly having a cylinder lock of the above-described general type but having plug carrying a tongue formed with a plurality of bittings. Inside the lock assembly a plurality of tumblers are provided each engageable with a respective bitting of the tongue carried on the plug and engageable with the locking element of the assembly so as to allow displacement of this element only between a locked and an unlocked position when the tumblers are in the aligned position.

With the assembly according to the present invention, therefore, forcible removal of the cylinder will not allow easy actuation of the lock, since it will be necessary thereafter to displace the tumblers into the aligned position in order to move the lock element. Therefore the lock according to the present invention has the advantages of the cylinder lock: a key which is easy to carry and inexpensive to duplicate, a lock which can be master-keyed, and a barrel which can readily be replaced for rekeying of the lock. In addition the lock offers all of the security of the tumbler-type of Tosic lock.

According to the present invention the tongue carried by the plug is either provided with or formed of a plurality of separate plates each constituting a respective one of the bittings and engageable with the respective one of the tumblers. Such a structure makes it possible to code the locks very easily. Furthermore if the cylinder is forcibly ripped out of the lock assembly the plates will come apart so that the burglar will have no indication of the coding of the tumblers still to be overcome within the lock.

BRIEF DESCRIPTION OF THE DRAWING

The above and other objects features, and advantages of the invention will become more readily apparent from the following, description reference being made to the accompanying drawing in which.

SPECIFIC DESCRIPTION

Figure 1:
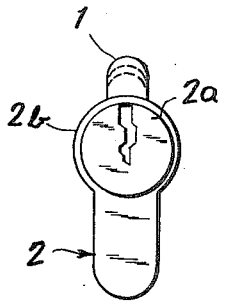
FIGS. 1 and 2 are front and side views, respectively, of the cylinder for the lock assembly according to the present invention.
Figure 2:
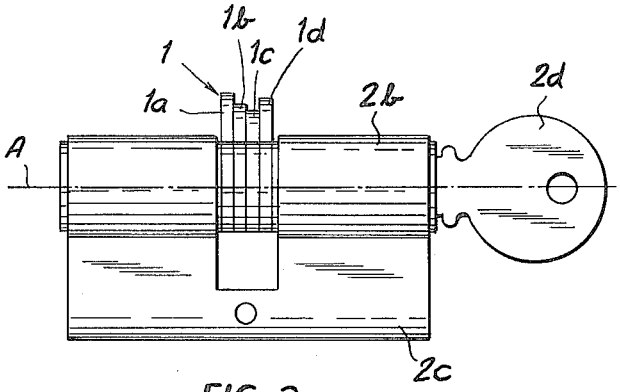

The lock assembly according to the present invention is operated by a cylinder lock 2 as shown in FIGS. 1 and 2. This lock 2 is of conventional design and has a plug 2*a* rotatable by means of a key 2*d* in a shell 2*b*. The springs and pin-tumblers are contained in an extension 2*c* on the lock 2. A tongue 1 formed of four plates 1*a*–*d* is linked to the plug 2*a* and is rotatable thereby about an axis A.

Figure 3:
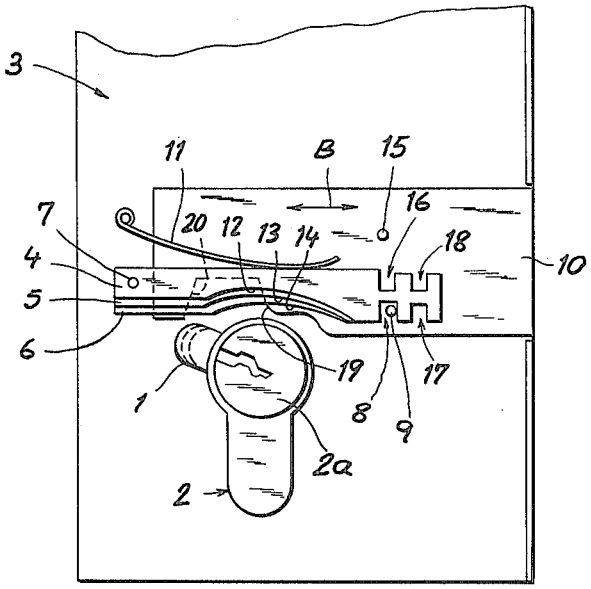
FIG. 3 is a front view of the lock assembly in accordance with this invention.

This lock 2 is fitted within a lock assembly shown in FIG. 3 and having a housing 3 in which a bolt 10 is reciprocal as indicated by arrow B. The plates 1*d*, 1*c*, and 1*b* are engageable with respective surfaces 12, 13, and 14 of respective tumbler bars 4, 5, and 6 all pivotal about a pin 7 parallel to the axis A and urged downwardly by a spring 11. In the unlocked position of the assembly shown in FIG. 3 a pin 9 carried on the bolt 10 is received within notches 8 of the tumbler bars, 4, 5, and 6. In this position it is impossible for the bolt 10 to be displaced in the direction or arrow B.

If an appropriately bitted key is inserted in the plug 2*a* and this plug is rotated so that the tongue 1 comes up against the tumblers 4, 5, and 6 these tumblers will all be lifted against the force of the spring 11 so that the pin 9 will not engage within the notches 8. If any of the tumblers 4–6 is lifted too far another pin 15 on the bolt 10 will engage within the appropriate notch 16 in the tumbler and prevent displacement of the bolt 10 in the direction of arrow B. Once the tumblers 4–6 are all lifted into an intermediate position between the pins 15 and 9, further rotation of the plug 2*a* will press the plate 1*a* of the tongue against a surface 19 of a notch formed in the bolt 10 and displace the bolt outwardly out of the housing 3 so as to move it into a locked position. Rotation of the plug 2*a* further will allow the tumblers to drop back down and will cause the pin 9 to engage in notches 17 further out on the tumblers 4–6.

The door is unlocked by rotating the plug 2*a* in the opposite direction so as first to lift the tumblers 4–6 such that the pin 9 is disengaged from the notches 17, and then to slide the bolt back by engagement of the plate 1*a* against the opposite face 20 of the notch formed in the bolt.

If the plug 2*a* or the plug 2*a* and the housing 2*b* are ripped out of the lock it will still be necessary in order for the thief to open the door or other closure on which the lock is fixed to move the tumbler bars 4–6 up into the exact aligned position in order to prevent engagement of the pins 9 or 15 in any of the notches 8, 16, 17, or 18. This operation in and of itself is extremely difficult and would foil all but the most expert lockpickers.

Furthermore, in case the key 2*d* is lost it is a relatively simple matter for the owner to take apart the lock and replace the entire cylinder lock 2. Furthermore the order of the stack of tumblers 4, 5, and 6 can be shifted around along with a corresponding shifting of the bitting plate 1*b*, 1*c*, and 1*d* so as to change the coding of the lock.

It is noted that instead of a conventional cylinder lock it is possible to provide a tubular-key lock, a combination lock, or the like.

I claim:

1. A lock assembly comprising:

a housing;

a cylinder lock having a shell fixed in said housing and a plug rotatable in said shell by means of a key;

a tongue carried on and jointly rotatable with said plug, said tongue being formed with a plurality of bittings;

a respective tumbler in said housing engageable with each of said bittings and displaceable thereby into an aligned position; and a locking element engageable with said tumblers and displaceable between a locked position and an unlocked position only with said tumblers in said aligned position.

2. The assembly defined in claim 1 wherein said tongue is formed of a plurality of plates each constituting a respective one of said bittings.

3. The assembly defined in claim 1 wherein said tongue carries a plurality of separate plates each constituting a respective one of said bittings.

4. The assembly defined in claim 1 wherein said tumblers are a plurality of pivotal bars.

5. The assembly defined in claim 4 wherein said element is a bolt slidable in said housing and provided with a pin, said bars being formed with respective notches engageable over said pin except in said aligned position.

* * * * *